US005173567A

United States Patent [19]

Fujita

[11] Patent Number: 5,173,567

[45] Date of Patent: Dec. 22, 1992

[54] MUSICAL TONE GENERATING APPARATUS WITH PARAMETER CONTROLLER FOR CHANGING CHARACTERISTICS OF MUSICAL TONE SIGNAL

[75] Inventor: Yoshio Fujita, Hamamatsu, Japan

[73] Assignee: Yamaha Corporation, Hamamatsu, Japan

[21] Appl. No.: 591,811

[22] Filed: Oct. 2, 1990

[30] Foreign Application Priority Data

Oct. 4, 1989 [JP] Japan ..... 1-259740

[51] Int. Cl.[5] ..... G10H 1/12; G10H 7/10; G10H 7/12

[52] U.S. Cl. ..... 84/607; 84/661; 84/DIG. 9; 364/723

[58] Field of Search ..... 84/607, 622-625, 84/659-661, 692-700, 735, 736, DIG. 9; 364/723, 724.01-724.2

[56] References Cited

U.S. PATENT DOCUMENTS 4,135,424 1/1979 Okamoto .
4,612,838 9/1986 Nagashima et al. ..... 84/607
4,843,938 7/1989 Hideo .

FOREIGN PATENT DOCUMENTS 50-114319 9/1975 Japan .

*Primary Examiner*—Stanley J. Witkowski
*Attorney, Agent, or Firm*—Spensley Horn Jubas & Lubitz

[57] ABSTRACT

A musical tone generating apparatus is provided for an electronic musical instrument. The apparatus comprises a musical tone signal generating device and a parameter controller. The musical tone signal generating device generates a musical tone signal characterized by a tone parameter whose value is supplied from the parameter controller. The parameter controller comprises a target value generator and an interpolation device, which operate independently. The target value generator generates a target value of the tone parameter to the interpolation device, and the interpolation device interpolates between a present value of the tone parameter and the target value, so that the present value is renewed consecutively. The interpolation device generates an interrupt signal to the target value generator when the present value reaches the target value, so that an operation of the target value generator is interrupted then the target value generator operates to generate a new target value to the interpolation device in response to the interrupt signal. The parameter controller changes a characteristic of the musical tone signal such as a frequency characteristic or amplitude with respect to a lapse of time based on the present value of the tone parameter.

16 Claims, 13 Drawing Sheets

MUSICAL TONE GENERATING APPARATUS WITH PARAMETER CONTROLLER FOR CHANGING CHARACTERISTICS OF MUSICAL TONE SIGNAL

BACKGROUND OF THE INVENTION

1. Field of the Invention

The present invention relates to a musical tone generating apparatus of an electronic musical instrument, which generates various musical tones.

2. Prior Art

Conventionally, in the electronic musical instrument, musical tone is generated by a tone generator, and its amplitude is controlled on the basis of the envelope signal, or musical tone is filtered by a filter which has a variable frequency characteristics. Thus, the musical tone has a peculiar tone color of an acoustic musical instrument. Hereafter, typical conventional apparatuses will be described.

The first conventional apparatus is disclosed in U.S. Pat. No. 4,135,424 and is shown in FIG. 17. In FIG. 17, there is an envelope generator of an electronic musical tone generating apparatus, which consists of a subtractor SUB, a multiplier M, a gate GT, an adder ADD and a shift register SRG. In the envelope generator, first of all, a target data Sa of the envelope of the musical tone is set on the subtractor SUB. The subtractor SUB subtracts a present data Sb from the target data Sa; that is, it calculates a difference between the target data Sa and the present data Sb. However, the present data Sb is an amplitude of the musical tone at present, and the target data Sa is a desired amplitude of the musical tone after a certain time. The difference is supplied to the multiplier M, wherein it is multiplied by a certain coefficient Sc (which is the number between 0 and 1, for example, $2^{-8}$), and is supplied to the adder ADD through the gate GT. The adder ADD adds the difference and the present data Sb, and outputs to the shift register SRG. As a result, the shift register SRG outputs a new present data Sb. Thus, the above-mentioned operations are performed with fixed interval (i.e., timing clock CK), and then, the envelope approaches the target data Sa, gradually. Finally, the envelope, i.e., the present data Sb, reaches the target data Sa. Therefore, if it changes the target Sa the envelope of the musical tone would change with passing time. As a result, the musical tone has a peculiar tone color of acoustic musical instrument.

Next, in the second conventional apparatus, waveform data of envelopes of the musical tone are memorized in a waveform memory, previously. Then, the waveform memory is accessed by a counter, so that the waveform data are outputted as the musical tone (data). At such time, a count of the counter is subtracted or is added on the basis of a clock plus. And then, the waveform data, i.e., the envelope, are changed by the variable count, following which the musical tone is controlled by the envelope. The musical tone has a peculiar tone color.

Next, the third conventional musical tone generating apparatus is disclosed in Japanese Utility Model Application laid-Open No. 50-114319 as is shown in FIG. 18. In FIG. 18, an envelope circuit 2 generates an envelope signal in accordance with operation of a keyboard 1. Next, an open-close circuit 3 is opened or closed according to the envelope signal; thus, the musical tone in accordance with operation of the keyboard 1 is outputted from a musical tone source 4. Also, the musical tone is filtered by a voltage control filter (VCF) 5, in which its cut-off frequency is controlled by the envelope signal. Thus, the musical tone which has a peculiar tone color is amplified by an amplifier AMP, then is outputted through a speaker SP as musical sound.

In addition, the fourth conventional musical tone generating apparatus is disclosed in U.S. Pat. No. 4,843,938 shown in FIG. 19. In FIG. 19, plural filter parameters which designate a frequency characteristic of a digital-filter 7, used as a tone color controller, are memorized in a memory 9 previously, and are supplied to the digital filter 7 according to touch information from a keyboard 1, in each fixed interval (Frame). Therefore, a musical tone from a waveform memory 9 is filtered by the digital-filter 8 having a frequency characteristic which changes with elapsed time. As a result, the envelope of the musical tone changes variously in accordance with the frequency characteristic. This musical tone is supplied to the D/A converter 10, and outputted as musical sound by the sound system SD.

However, the above-mentioned conventional apparatuses as shown in FIG. 17, FIG. 18, FIG. 19, and the third apparatus, repeatedly read out the waveform data of the musical tone within the predetermined segment from the continuous tone waveform. The tone color is not varied smoothly at a time when the conventional apparatus begins to read out the tone waveform data at the front portion of the segment after reading out the musical tone waveform data at the end portion of the segment. For this reason, there is an unnatural portion heard in the generated musical tone.

The apparatuses have waveforms having various segment structures, or have various filter characteristics, so that, for example, it is necessary to provide a complicated enveloped generator, or to provide a large filter characteristic memory.

SUMMARY OF THE INVENTION

Accordingly, it is a purpose of the present invention to provide a musical tone generating apparatus which changes at least parameters which characterize tone color of the musical tone, with a time dependence coefficient. According to an aspect of the present invention, there is provided a musical tone generating apparatus comprising: (a) musical tone source means for generating a musical tone according to operational style of a performer; (b) parameter control means for changing at least one parameter which characterizes tone color of said musical tone, said parameter control means having a variable characteristic representing a degree of change; and (c) coefficient generator means for generating a coefficient, which is supplied to said parameter control means to change said characteristic of said parameter control means, said coefficient being capable of changing with passing time.

As a result, according to the present invention, it is possible to obtain the musical tone without expanding and complicating the apparatus. In addition, it is possible to obtain a varied musical tone whose tone color can be varied smoothly.

BRIEF DESCRIPTION OF THE DRAWINGS

Further objects and advantages of the present invention will be apparent from the following description, reference being had to the accompanying drawing wherein a preferred embodiment of the present invention is clearly shown.

In the drawings.

DETAILED DESCRIPTION OF THE PREFERRED EMBODIMENTS

A. CONFIGURATION OF EMBODIMENT

Figure 1:
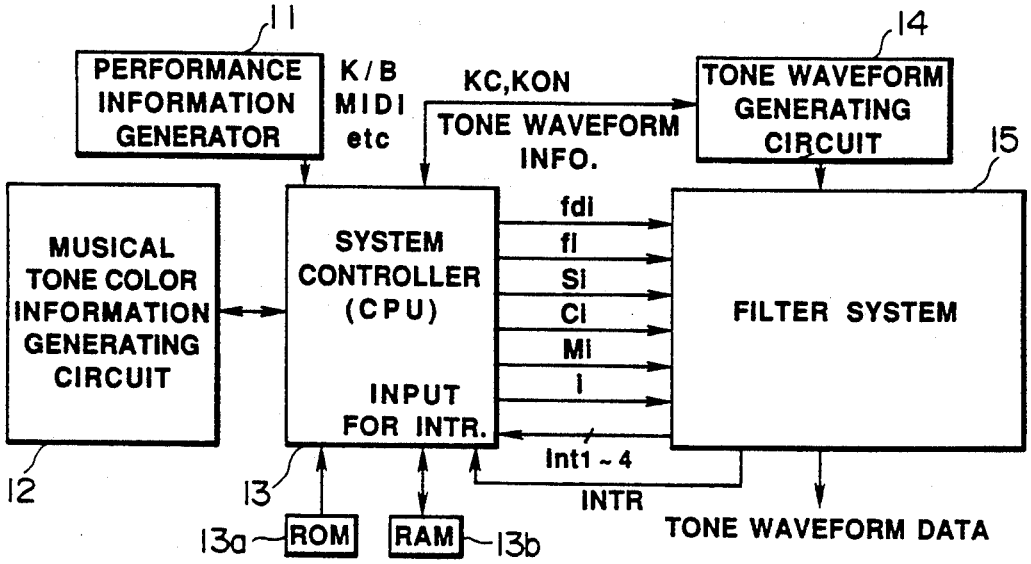
FIG. 1 is a block diagram showing an electronic configuration of an electronic musical instrument which adopts a musical tone generating apparatus according to an embodiment of the present invention.

FIG. 1 is a block diagram showing the electronic configuration of the musical tone synthesizing apparatus according to the present invention. In FIG. 1, the performance information generator 11 consists of a keyboard which transmits a keycode KC, a key-on signal KON, a key-off signal KOFF, a key-on velocity KV and a key-off velocity KOFFV, as information representative of touching of the keyboard, to the system controller 13. In addition, the musical tone control information generating circuit 12 consists of a plurality of manually operable members such as a volume portion, a pitchbent portion and so on. The musical tone control information generating circuit 12 generates tone information, in accordance with the detected operation of each of the manually operable members, to the system controller 13. The system controller 13 consists of a CPU (Central processing Unit), a memory portion and so on, which the system controller 13 controls, in accordance with predetermined programs. The controller 13 outputs a keycode KC, a key-on signal KON, a key-off signal KOFF, a key-on velocity KV, key-off velocity KOFFV and tone color parameters, on the basis of the foregoing tone information, to a tone waveform generating circuit 14. The system controller 13 also outputs the various tone designating information (a target cut-off frequency fdi, a initial cut-off frequency fi, a interpolation velocity Si, a filter designating number i, a start-bit Ci and a mode-bit Mi). Various performed programs are stored in a read only memory (ROM) 13*a*. In addition, various parameters and data for the CPU are stored in a random access memory (RAM) 13*b*.

The tone waveform generating circuit 14 generates tone waveform data on the basis of the above-mentioned keycode KC, the key-on velocity KV, the key-on KON, the key-off velocity KOFFV, the key-off KOFF and the tone color parameters, and outputs the tone waveform data to the filter system 15. The filter system 15 constructs a multiple filter by a time sharing technique, and its cut-off frequency Fi is changed toward the target frequency fdi from the initial frequency fi with a velocity, which is in accordance with the interpolation velocity Si, when the above-mentioned initial frequency fi and the target frequency fdi are established by the system controller 13. Therefore, the tone waveform data is filtered by the filter system 15. The filter tone waveform data is supplied to the level controller 6. The filter system 15 outputs interrupt signals Inti which are in accordance with each filter, to the system controller 13.

However, the cut-off frequency Fi, the target frequency fdi, the initial frequency fi, the interpolate velocity Si, the filter designating number i, the start-bit Ci, the mode-bit Mi and the interrupt signal Inti have an index (i) designating from (1) to (4), that is; data designated by (1) are in accord with filter unit FU1, data designated by (2) are in accord with filter unit FU2, data designated by (3) are in accord with filter unit FU3, and data designated by (4) are in accord with filter unit FU4.

Next, the filter system 15 will be described by referring to FIG. 2.

(1) Configuration of Filter System 15

Figure 2:
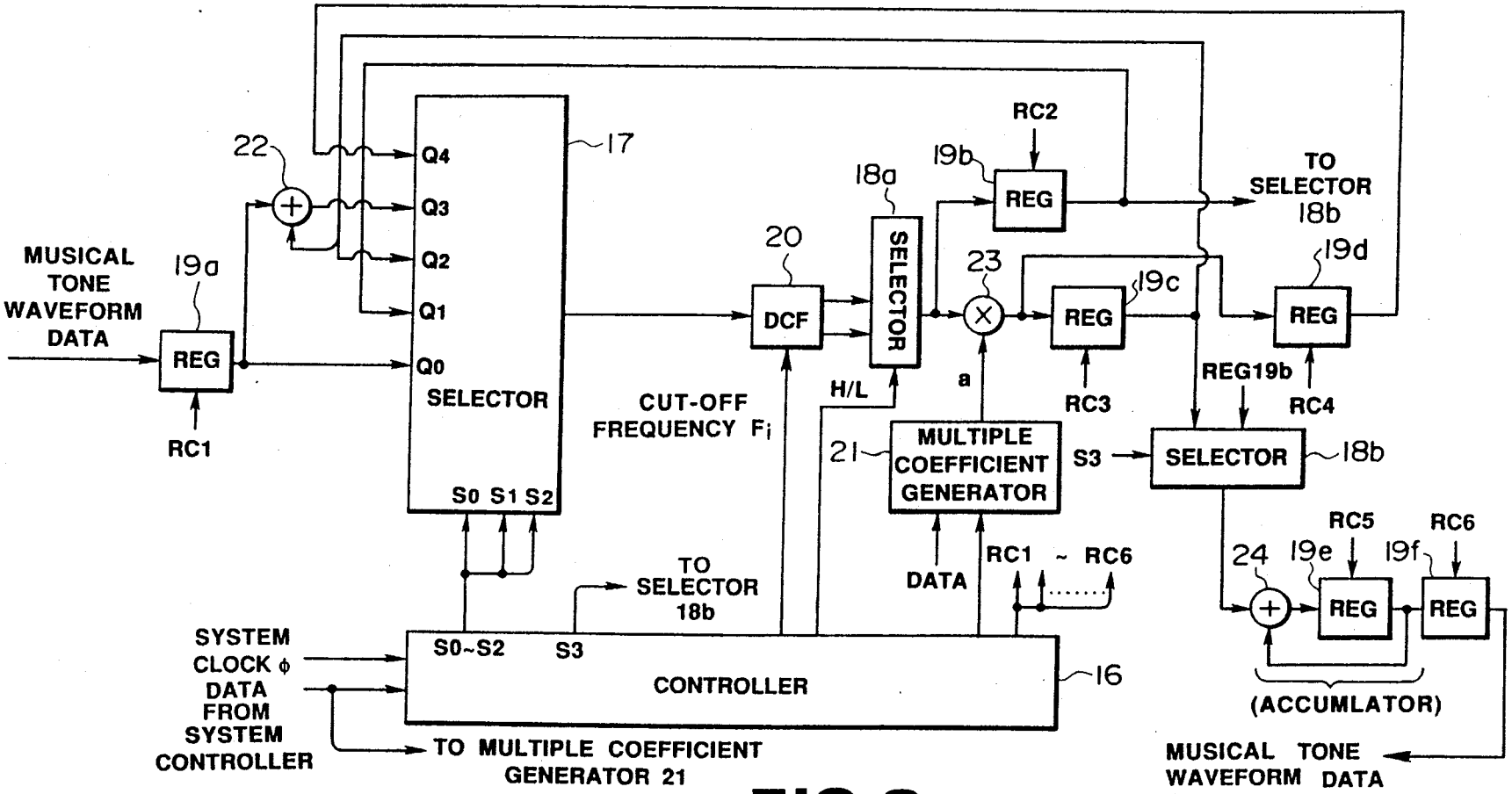
FIG. 2 is a block diagram showing an electronic configuration of a filter system 15 shown in FIG. 1.
Figure 4A:
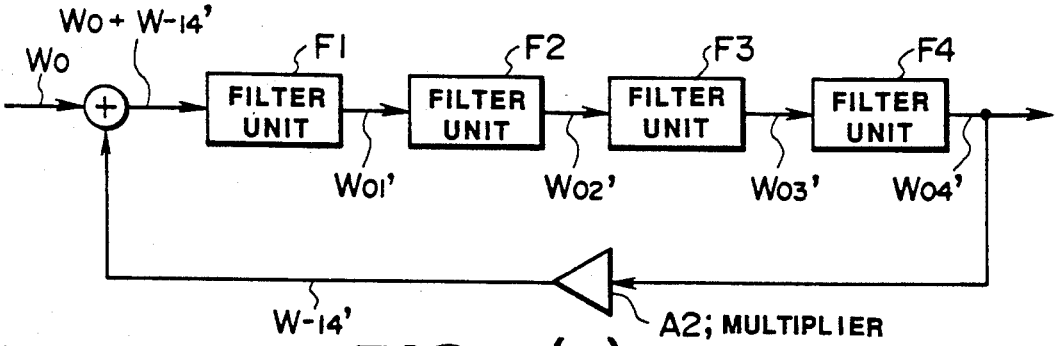
FIGS. 4(*a*)~(*g*) are block diagrams showing filter flows which are constructed by filter system 15.
Figure 4B:
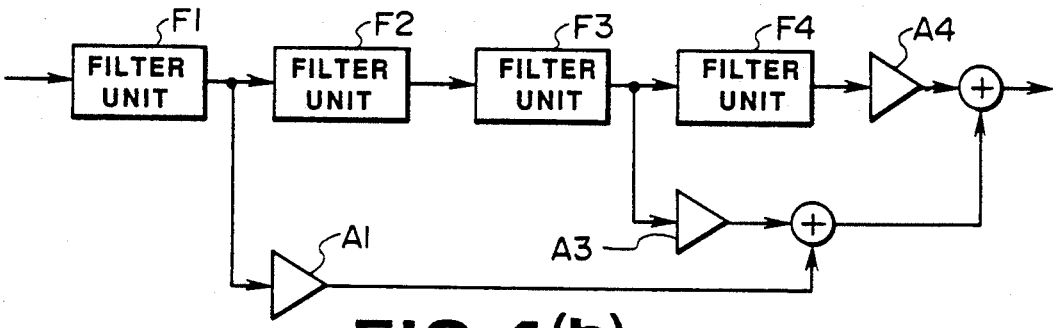
Figure 4C:
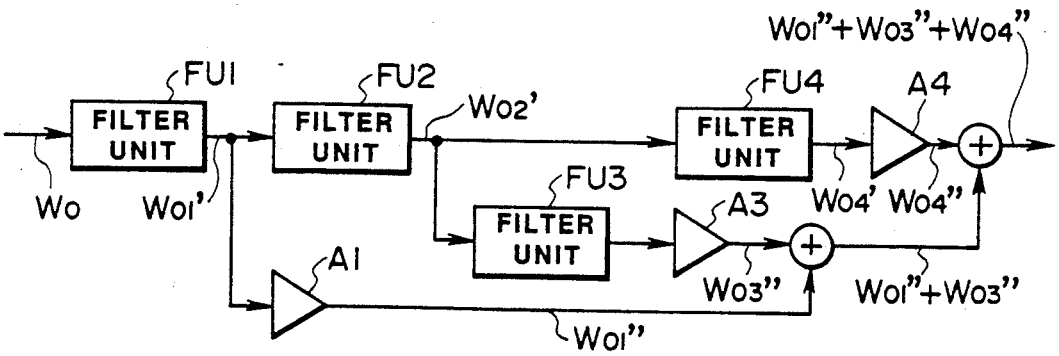
Figure 4D:
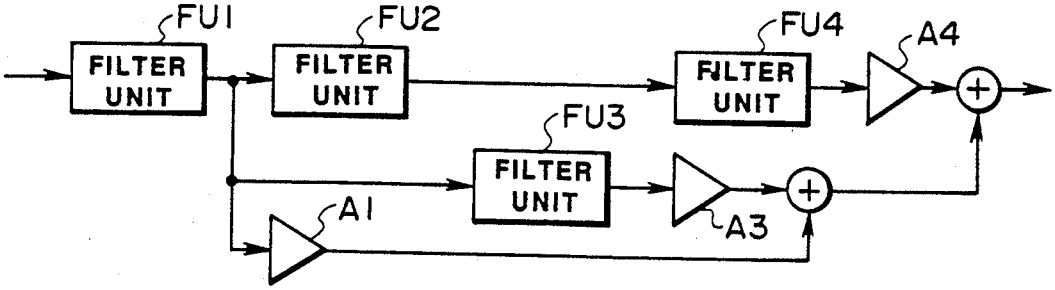
Figure 4E:
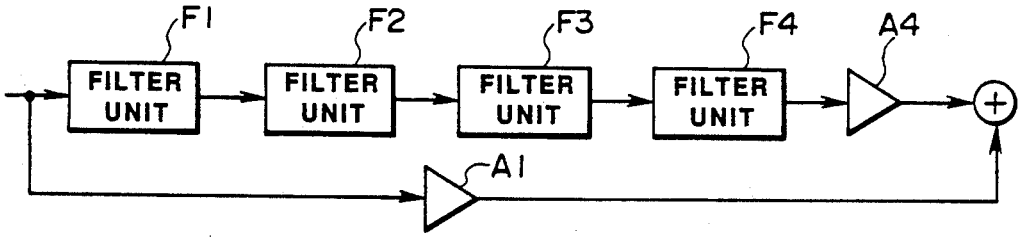
Figure 4F:
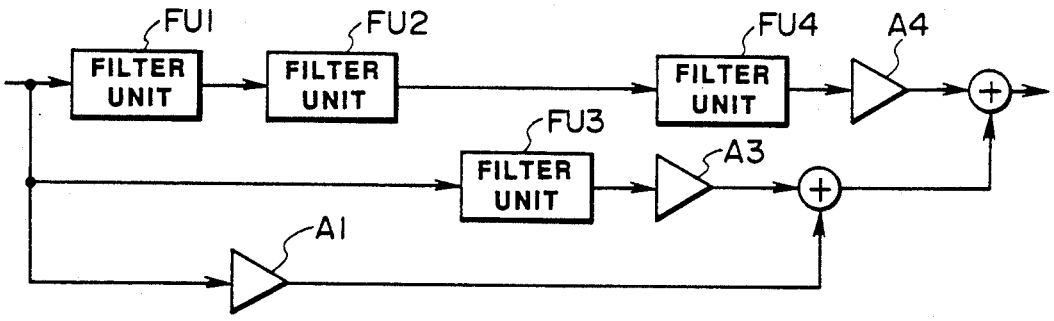
Figure 4G:
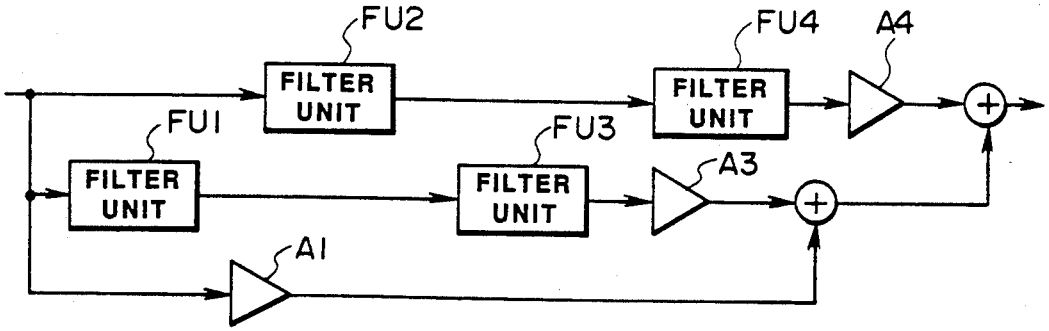

FIG. 2 is a block diagram showing the filter system 15. In FIG. 2, the filter system 15 consists of a controller 16, selectors 17, 18*a*, 18*b*, registers (REG) 19*a*, 19*b*, 19*c*, 19*d*, 19*e*, 19*f*, a digital filter (DCF) 20 and a multiple coefficient generator 21.

The controller 16 controls the working timing of each portion, and outputs various data to the above-mentioned portions. The controller 16 is supplied with the system clock $\phi$ and the above-mentioned tone designation information. The controller 16 outputs signals S0, S1 and S2 to the selector 17, and also outputs control signals RC1~RC6 to each of the register 19*a*~19*f*. Furthermore, the controller 16 outputs a H/L signal to the selector 18*a*, and outputs the cut-off frequency f to the DCF 20, respectively.

Next, REG 19*a* latches the tone waveform data and outputs the latched tone waveform data on the basis of the control signal RC1 to the input-terminal Q0 of the selector 17 and the adder 22.

The selector 17 outputs data to the DCF 20, which data consists of one of a plurality of data existing on terminals Q0~Q4 selectively, according to the state of signals S0, S1 and S2.

Figure 3:
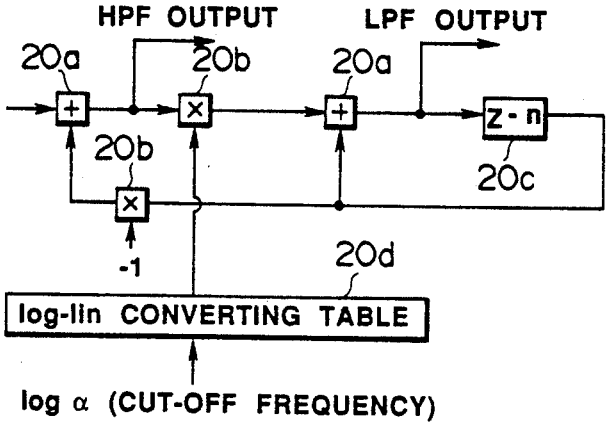
FIG. 3 is a block diagram showing an electronic configuration of a DCF 20 shown in FIG. 2.

The DCF 20 consists of adders 20*a*, 20*a*, multipliers 20*b*, 20*b*, a delay circuit 20*c* and a log-lin converting table 20*d*, as shown in FIG. 3. The cut-off frequency Fi of the DCF20 are controlled by the parameter log$\alpha$ corresponding with logarithm value of the cut-off frequency d. The DCF 20 prepares two outputs as high-pass filter (HPF) and low-pass filter (LPF). Both outputs of the HPF and the LPF of DCF 20 are supplied to the selector 18*a*.

The selector 18*a* selects one of the tone waveform data, which are supplied through the HPF, corresponding with the H/L signal, and outputs the selected tone waveform data to the multiplier 23 and the REG 19*b*.

The REG 19*b* latches the tone waveform data, which is outputted from the DCF 20, corresponding with the control signal RC2. The tone waveform data which is outputted from REG 19*b* is supplied to the input-terminal Q1 of the selector 17 and the selector 18*b* on the basis of the tone designation information.

The multiple coefficient generator 21 generates multiple coefficients on the basis of the tone designation information, and outputs the multiple coefficients to the multiplier 23.

Next, the multiplier 23 multiplies the multiple coefficient by the tone waveform data, and then controls the level of the tone waveform data. The level-controlled tone waveform data is supplied to the REG 19*c* and the REG 19*d*. The REG 19*c* latches the level-controlled tone waveform data corresponding to the control signal RC3. The tone waveform data from the REG 19 is supplied to the input-terminal Q2, the selector 18*b* and the adder 22, respectively.

The adder 22 adds the tone waveform data from the REG 19*a* and the tone waveform data from the REG 19*c*, and then outputs the added result to the input-terminal Q3 of the selector 17. The REG 19*d* temporarily stores the tone waveform data from the multiplier 23 corresponding to the control signal RC4. The output of REG 19*d* is supplied to the input-terminal Q4 of the selector 17.

Furthermore, the selector 18*b* selectively outputs data from the REG 19*b* or from the REG 19*c* to the adder 24. The output data of the adder 24 is supplied to the REG 19*e*. The REG 19*e* is an accumulator, and maintains temporarily the output data from the adder 24 corresponding to the control signal RC5. The output data of REG 19*e* is supplied to the REG 19*f* and the adder 24. That is, the adder 24 adds the output data of selector 18*b* and the output data of REG 19*e*. As a result, REG 19*e* maintains the added result of the output data from selector 18*b* and the content of REG 19*e*. The REG 19*f* is a filter flow outputting register, and maintains temporarily the final tone waveform data from the filter system 15, and outputs it to the level controller 6.

Next, the filter flow of multiple formation which consists of the filter system 15 will be described.

i. Configuration of Filter Flow

In the filter system 15, each of the selectors 17, 18*a*, 18*b* and each of the REG 19*a*~19*f* is respectively controlled by the select signal S0~S3 and the control signal RC1~RC6. As a result, for example, the filter system 15 forms at least one of the multiple filter flows as shown in FIGS. 4(*a*)~(*g*).

Hereinafter, description will be given with respect to the detailed explanation of the multiple filter flows by referring to FIGS. 4(*a*)~(*g*). DCF 20 performs the filter units FU1~FU4 shown in FIGS. 4(*a*)~(*g*) by the means of time sharing. A number of each of the filter units FU1~FU4 designates the order of the time series. A1~A4 designate multipliers which control the level of the tone waveform data through each signal path. The multiplier 23 performs the multipliers A1~A4 shown in FIG. 2 by means of time sharing in the same way as the DCF 20.

Figure 5:
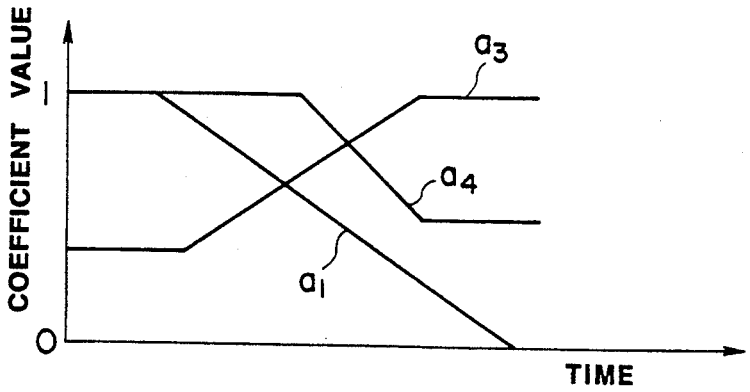
FIG. 5 is a chart showing an example of the varying manner of multiple coefficients $a_1$, $a_2$, $a_3$ and $a_4$ in the embodiment.

The multipliers A1~A4 are in accord with the multiplier 23 shown in FIG. 2, and each number (1)~(4) designates on order for using as a filter unit. Each coefficient a1, a2, a3 and a4 of the multipliers A1~A4 is a multiple coefficient which is outputted from the multiple coefficient generator 21, by which they are controlled independently. Herein, FIG. 5 is an example, in which these coefficients a1, a2, a3 and a4 are changed with passing time by the multiple coefficient generator 21. However, their set-values and inclinations may be changed corresponding to an operation (as key touch pressure) of a performer.

The multiplier A2 shown in FIG. 4(*b*) controls feedback degree on the feedback path. In this case, the multiplier A2 has the ability to represent a resonance characteristic as a frequency characteristic of the multiple filter flow.

Next, the operation of the filter system for forming the above-mentioned multiple filter flows will be described by referring to FIG. 2, FIG. 4 and FIGS. 6(*a*), (*b*).

ii. Operation of Filter System

FIG. 4(*c*) is an example of the block diagram showing the filter system. In FIG. 4(*c*), the filter units FU1, FU2, FU3 and FU4 are connected in series, and the output signals of the filter units are controlled independently by multipliers A1, A2, A3 and A4, respectively.

Figure 6A:
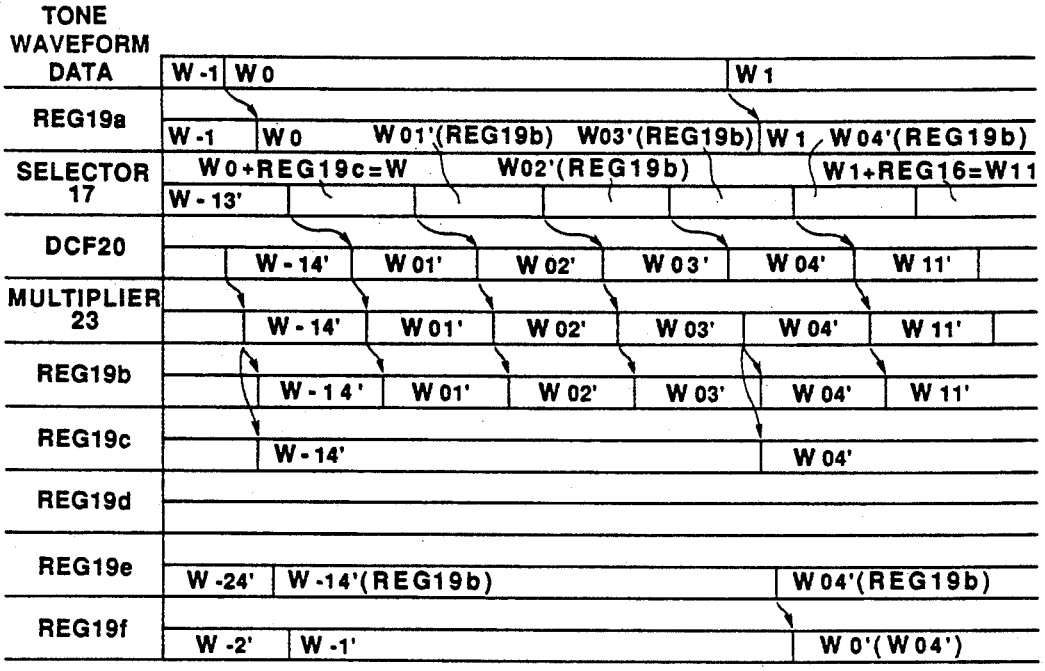
FIGS. 6(*a*) and (*b*) are timing charts showing operations of the filter flows.
Figure 6:
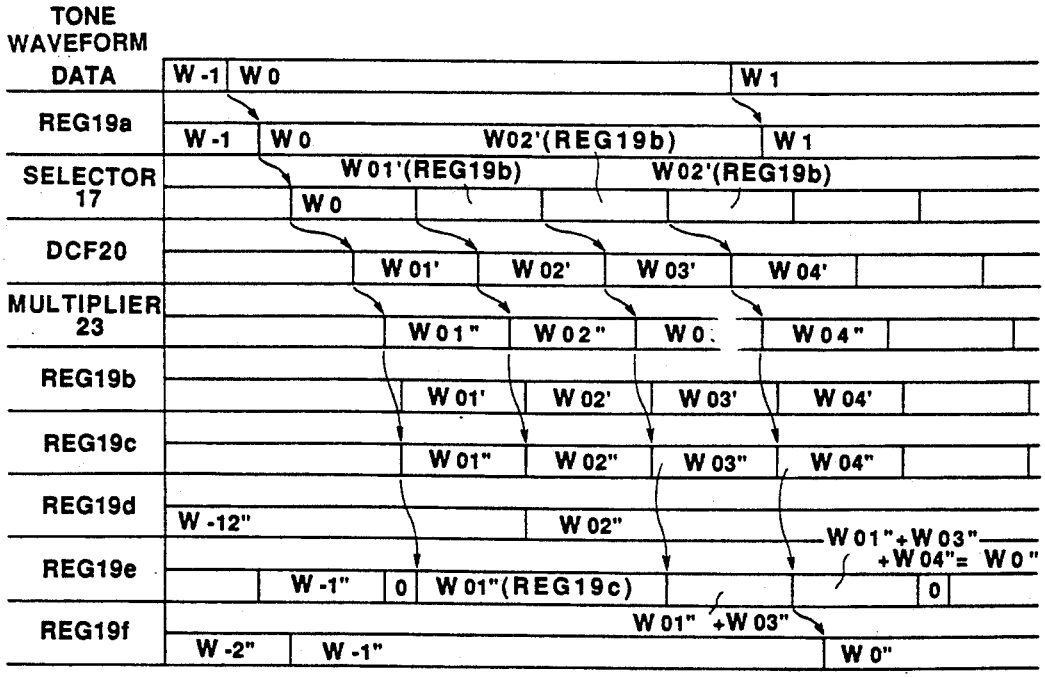

In this case, each portion of the filter system is operated according to the procedure as shown in FIG. 6(*a*). First of all, the selector 17 outputs selectively data which is received into the input-terminal Q0 again. In this case, the selector 17 outputs the output data of REG 19*a*, i.e. the tone waveform data $W_0$. Hereinafter, each of the above-mentioned portions outputs the tone waveform data $W_{01}''$ to the REG 19*c* in the same way as the above-mentioned operation for the first filter flow FU1. The tone waveform data $W_{01}''$ from the REG 19*c* is supplied to adder 24 by selector 24. In the adder 24, the output data of the REG 19*e* and the tone waveform data $W_{01}''$ are added. The output data of the adder 24 will be tone waveform data $W_{01}''+W_{01}$ because the tone waveform data $W_{01}''$ is latched in REG 19. The tone waveform data $W_{01}''$ is latched in the REG 19*e* (refer to FIG. 4(*a*)).

Filtering as described above is repeated two more times, and then finally, the REG 19*e* latches tone waveform data $W_{01}''+W_{01}''+W_{01}''+W_{01}''$. Next, the tone waveform data $W_{01}''+W_{01}''+W_{01}''+W_{01}''$ is latched in REG 19*f* and outputted (refer to the tone waveform data $W_{01}''+W_{01}''+W_{01}''+W_{01}''$ in FIG. 4(*a*)). Further, multiple coefficient ai is changed as a1, a2, a3 and a4 at each stage of the time sharing. In these circumstances, the multiple filter system is formed from an individual filter flow unit with the use of the time sharing concern.

Next, another example of a filter flow will be described, which is formed with filter units FU1, FU2, FU3 and FU4 connected in series and fed back by multiplier A2, shown in FIG. 4(*a*). In this case, each portion of the filter system is operated according to the procedure as shown in FIG. 6(*a*). First of all, the tone waveform data $W_0$ is latched by the REG 19*a*. The selector 17 outputs selectively data which is supplied into the input-terminal Q3 according to the select signal S0, S1 and S2 from the controller 16. Thus, the output data of the selector 17 will be data added the tone waveform data $W_0$ to the output data of the REG 19*c*. The REG 19*c* latches the former data of the tone waveform data $W_{-14}''$ (not described). Therefore, the selector 17 outputs the added data as tone waveform data $W_0+W_{-14}''$. Hereinafter, the output data from the selector 17 is referred to as tone waveform data $W_{01}$. The tone waveform data $W_{01}$ is supplied to the DCF 20, and filtered (refer to $W_{01}'$ in FIG. 4(*a*)). The filtered tone waveform data is then supplied to the REG 19*b* as tone waveform data $W_{01}'$. The REG 19*b* latches the tone waveform data $W_{01}'$.

Next, the selector 17 outputs selectively the supplied data into input-terminal Q1, according to the select signals S0, S1 and S2 from the controller 16. Therefore, the selector 17 outputs the output data of the REG 19*b* to the DCF 20. Further, the tone waveform data $W_{01}'$ is latched in the REG 19*b*, so that the same waveform data is also filtered by the DCF 20. This filtering is repeated two times, so that the DCF 20 outputs tone waveform data $W_{02}'$, $W_{03}'$ and $W_{04}'$, sequentially (refer to $W_{02}'$, $W_{03}'$ and $W_{04}'$ in FIG. 4(*b*)). The last tone waveform data $W_{04}'$, is then latched by REG 19*b*, and further it is supplied to the multiplies 23. Next, the selector 18*b* supplies selectively the tone waveform data $W_{04}'$ as the output data of the REG 19*b* to the adder 24, according to the select signal S3. And, the output data of the REG 19*e* and the tone waveform data $W_{04}'$ are added in adder 24. The output data of the data 24 will be a tone waveform data $W_{04}'$ unchanged because the REG 19*e* has been cleared to zero by initial establishment. The tone waveform data $W_{04}'$ is latched by REG 19*e*. Further, this tone waveform data $W_{04}$ is latched in the REG 19*f* and outputted.

In these circumstances, the filter flow is formed by the multiple filter system shown in FIG. 4(*a*) by time sharing.

Furthermore, description will be given another example of the filter flow shown in FIG. 4(*c*). In this case, each portion of the filter system is operated with a procedure as shown in FIG. 6(*b*). First of all, tone waveform data $W_0$ is latched by REG 19*a*. The selector 17 outputs selectively data which is supplied to input-terminal $Q_0$. Therefore, the selector 17 outputs tone waveform data $W_0$. This tone waveform data $W_0$ is filtered by DCF 20, and then outputted from DCF 20 as waveform data $W_{01}'$. This tone waveform data $W_{01}'$ is latched by REG 19*b*(refer to $W_{01}'$ in FIG. 4(*c*)). The multiple coefficient a1 from the multiple coefficient generator 21 is supplied to the multiplier 23. In the multiplier 23, the level of tone waveform data $W_{01}$ is controlled according to the multiple coefficient a1. Here, this level-controlled tone waveform data is defined as the tone waveform data $W_{01}''$ (refer to $W_{01}''$ in FIG. 4(*d*)). The tone waveform data $W_{01}''$ is latched by the REG19*c*, and is supplied to the adder 24 though the selector 18*b*. So, the tone waveform data $W_{01}''$ and the output data of the REG 19*e* is added in the adder 24. The output data of the adder 24 will be a tone waveform data $W_{04}''$ unchanged because the above-mentioned REG 19*e* has been cleared to zero by initial establishment. Therefore, the tone waveform data $W_{01}''$ is latched by the REG 19*e* without any change.

Next, the above-mentioned selector 17 outputs data which is supplied into the input-terminal Q1. Thus, the selector 17 outputs the output data of the REG 19*b* to the DCF 20. In the REG 19*b*, because the tone waveform data $W_{01}'$ is latched, this tone waveform data $W_{01}'$ is filtered again, and becomes tone waveform data $W_{02}'$ (refer to $W_{02}'$ in FIG. 4(*c*)). The tone waveform data $W_{02}'$ is supplied to the REG 19*b* and to the multiple 23 in the same way as the above-mentioned first example. The REG 19*b* latches the tone waveform data $W_{02}'$, and outputs to the input-terminal Q1 of the selector 17.

On the other hand, the level of the tone waveform data $W_{02}'$, which is supplied to the multiple 23, is controlled according to multiple coefficient a1. Herein, the multiple coefficient $a_1$ is set to (1). The level-controlled tone waveform data $W_{02}''(=W_{02}')$ is latched by the REG 19*c* and by the REG 19*d*. However, at this time, the output data of the REG 19*c* is not supplied to the adder 24 though the selector 18*b*. Thus, the REG 19*e* holds the above-mentioned tone waveform data $W_{01}''$.

Next, the selector 17 outputs the output data of the REG 19*b*, which is supplied to the input-terminal Q1, to the DCF 20 according to select signals S0, S1, and S2 from the controller 16. The REG 19*b* latches the tone waveform data $W_{02}'$, so that the tone waveform data $W_{02}'$ is filtered by DCF 20 and then is outputted from DCF 20 as a tone waveform data $W_{03}'$ (refer to FIG. 4(*c*)). Then, the tone waveform data $W_{03}'$ is supplied to the REG 19*b* and the multiplier 23. In multiplier 23, the multiple coefficient a3 from the multiple coefficient generator 21 is also supplied. Thus, the multiplier 23 controls the level of the tone waveform data $W_{03}'$ according to the multiple coefficient a3. Hereinafter, the controlled tone waveform data is referred to as tone waveform data $W_{03}''$ shown in FIG. 4(*c*). The tone waveform data $W_{03}''$ is then latched by the REG 19*c*. Furthermore, the tone waveform data $W_{03}''$ from the REG 19*c l is supplied to the adder 24 through the selector 18b*. In the adder 18*b*, the tone waveform data $W_{03}''$ and the output data of the REG 19*e* are added. Therefore, the adder 24 outputs the tone waveform data $W_{01}''+W_{03}''$, because the tone waveform data $W_{01}''$ had been latched by REG 19*e*. The tone waveform data $W_{01}''+W_{03}''$ is then latched by REG 19*e*.

Next, the selector 17 selects the input-terminal Q4 side, in which the output data of the REG19*d* is inputted, and outputs the selected data to the DCF 20. Thus, the tone waveform data $W_{02}''(=W_{02}')$ which is latched by the REG 19*d* is filtered by the DCF 20 again. Hereinafter, the filter tone waveform data is referred to as tone waveform data $W_{04}'$ shown in FIG. 4(*d*). The tone waveform data $W_{04}'$ is supplied to the REG 19*b* and to the multiple 23. The REG 19*b* latches the tone waveform data $W_{04}'$. However, the multiplier 23 controls a level of the tone waveform data $W_{04}'$ according to the multiple coefficient $a_4$. The output signal of multiplier 23, as tone waveform data $W_{04}''$, is latched by REG 19*c* (refer to $W_{04}''$ in FIG. 4(*c*)). The tone waveform $W_{04}''$ is supplied to the adder 24 through the selector 18*b*. In the adder 24, the tone waveform data $W_{04}''$ and the output data of the REG 19*e* are added. Therefore, in this case, the adder 24 outputs tone waveform data $W_{01}''+W_{03}''+W_{04}''$, because the REG 19*e* latches the tone waveform data $W_{01}''+W_{03}''$ as mentioned above (refer to $W_{01}''+W_{03}+W_{04}''$ in FIG. 4(*c*)). Then, tone waveform data $W_{01}''+W_{03}''+W_{04}''$ is latched by the REG 19*e* and by the REG 19*f*, and is outputted.

As explained above, the multiple filter flows shown in FIGS. 4(*a*)~(*g*) are formed by the filter system 15.

However, the multiple coefficients a1~a4 may be uniform data, data which are changed with time passed, or both mixed data.

In addition, the techniques of conventional envelope generator are self-evident to apply in the means which changes coefficients a1~a4. Furthermore, signals in accordance with various operations by a performer may be applied as coefficients a1~a4.

Next, the controller 16 shown in FIG. 2 will be described by referring to block digrams shown in FIG. 6 and FIG. 7.

2. Configuration of Controller 16.

Figure 7:
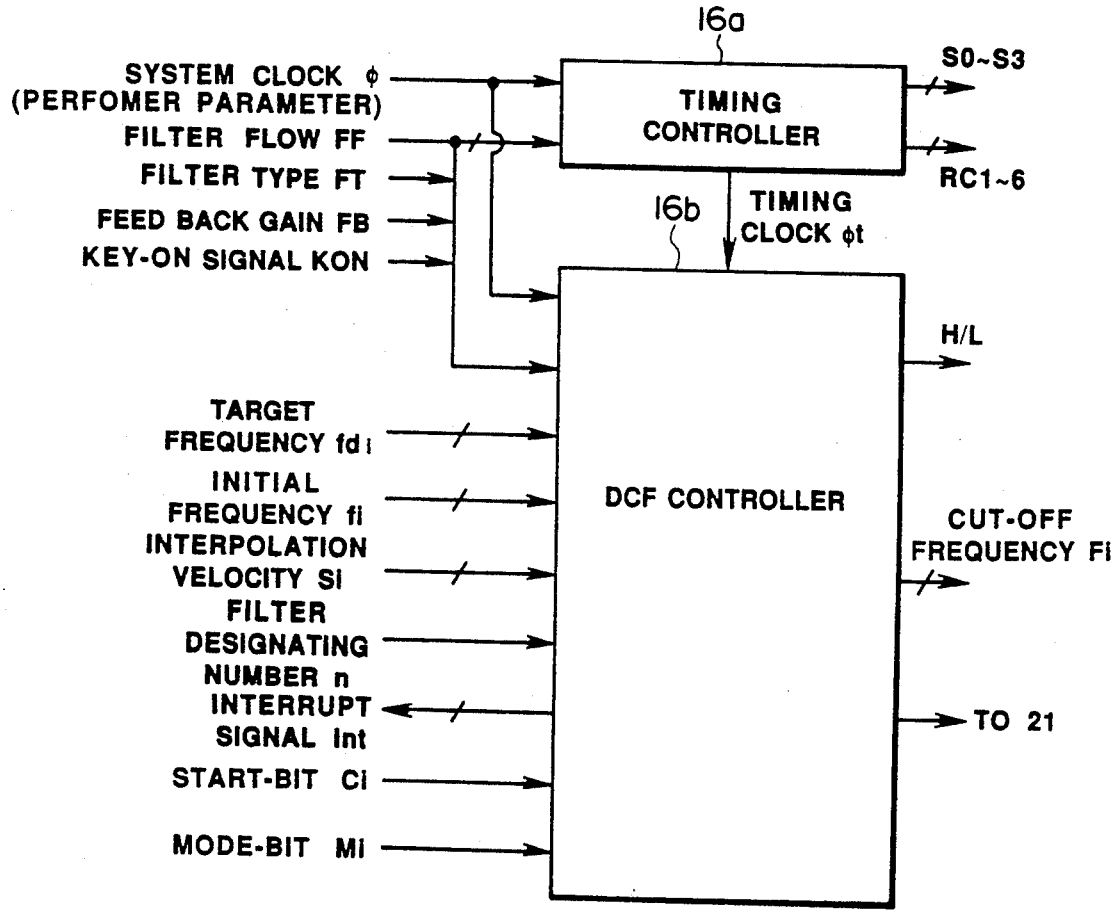
FIG. 7 is a block diagram showing a controller 16 shown in FIG. 2.

In FIG. 7, the controller 16 consists of a timing controller 16*a* and a DCF controller 16*b*. The timing controller 16*a* outputs the above-mentioned signals S0, S1, S2 and the control signals RC1~RC6 on the basis of a system clock $\phi$, a time-sharing control signal (from the system controller 13) and operating parameters, such as a filter flow FF, a filter type TP, a feed back gain FB, a key-on signal KON and so on as shown in FIG. 2. Next, the DCF controller 16*b* transmits the cut-off frequency f and the H/L signal to the DCF 20. Here, H/L signal designates either the LPF or the HPF output to be transmitted to the DCF 20. And, the DCF controller 16*b* also outputs a control signal to the multiple coefficient generator 21. The DCF controller 16 receives the present frequency fn, the target frequency fd and the interpolation velocity Si, as the above-mentioned tone designation information. The DCF controller 16 calculates interpolation data between discrete data using linear interpolation in each fixed interval. In this case, the discrete data are the present frequency fn and the target frequency fd(fd~fn).

Figure 17:
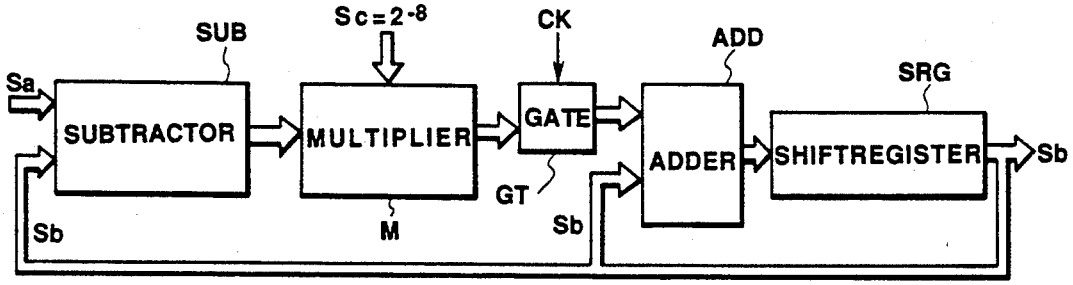
FIG.17 (PRIOR ART)
FIG. 17 is a block diagram showing the electronic configuration of the first conventional musical tone generating apparatus.
Figure 18:
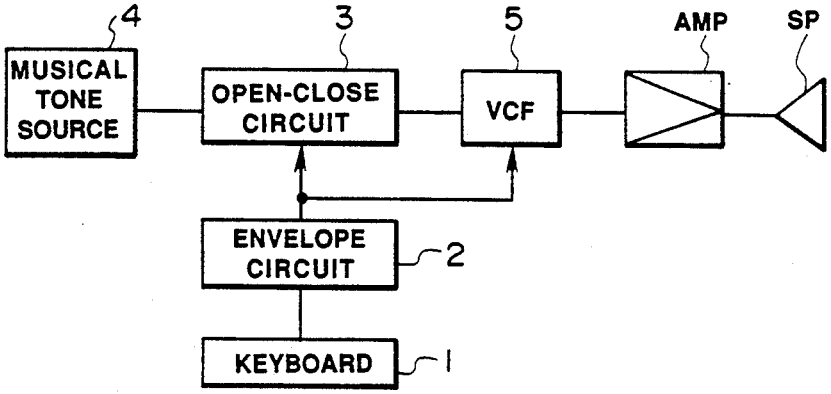
FIG.18 (PRIOR ART)
FIG. 18 is a block diagram showing the electronic configuration of the third conventional musical tone generating apparatus.
Figure 19:
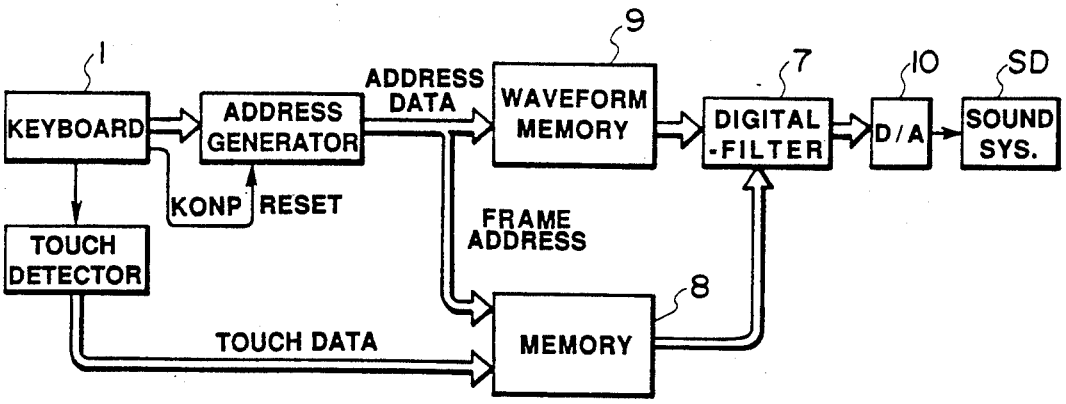
FIG.19 (PRIOR ART)
FIG. 19 is a block diagram showing the electronic configuration of the fourth conventional music tone generating apparatus.

The fundamental expression of the cut-off frequency Fi has an algorithm which corresponds to the conventional apparatus (U.S. Pat. No. 4,135,424) shown in FIG. 17. That is, it is assumed that a cut-off frequency Fi at time (0) is an initial frequency fi, and at this time, the cut-off frequency Fi is designated; as $$F(0)=fi \tag{1}$$

And, at an optional time, the cut-off frequency Fi is designated; as $$F(t)=F(t-1)+(fd-F(t-1))/S \tag{2}$$

This expression (2) is transformed by Z-transformation;

$$F=F*Z^{-1}+(fd-f*Z^{-1})/S \tag{3}$$

Thus, the expression (3) will be;

$$F=\frac{fd/S}{(1-(1-1/S)*Z^{-1})} \tag{4}$$

Next, the expression (4) is transformed by inverse-Z-transformation considering initial value;

$$F(t)=fi+(fd/S)*(1-1/S)^t \tag{5}$$

Therefore, the cut-off frequency Fi changes from the initial frequency fi toward the target fdi with an exponential curve. In other words, a newly calculated cut-off frequency Fi is the present frequency Fi+(the target frequency fdi-the present frequency Fi)*coefficient. Then, the cut-off frequency Fi is supplied to the DCF 20.

The DCF controller 16*b* outputs the interrupt signal Inti to the controller system 13 when the cut-off frequency Fi reaches the frequency fdi. The interrupt signal Inti is outputted according to each of filter units FU1, FU2, FU3 and FU4.

Furthermore, the above-mentioned calculation method will be described by referring to the block diagram of the DCF controller 16*b* shown in FIG. 8.

3. Configuration of DCF Controller 16*b*

Figure 8:
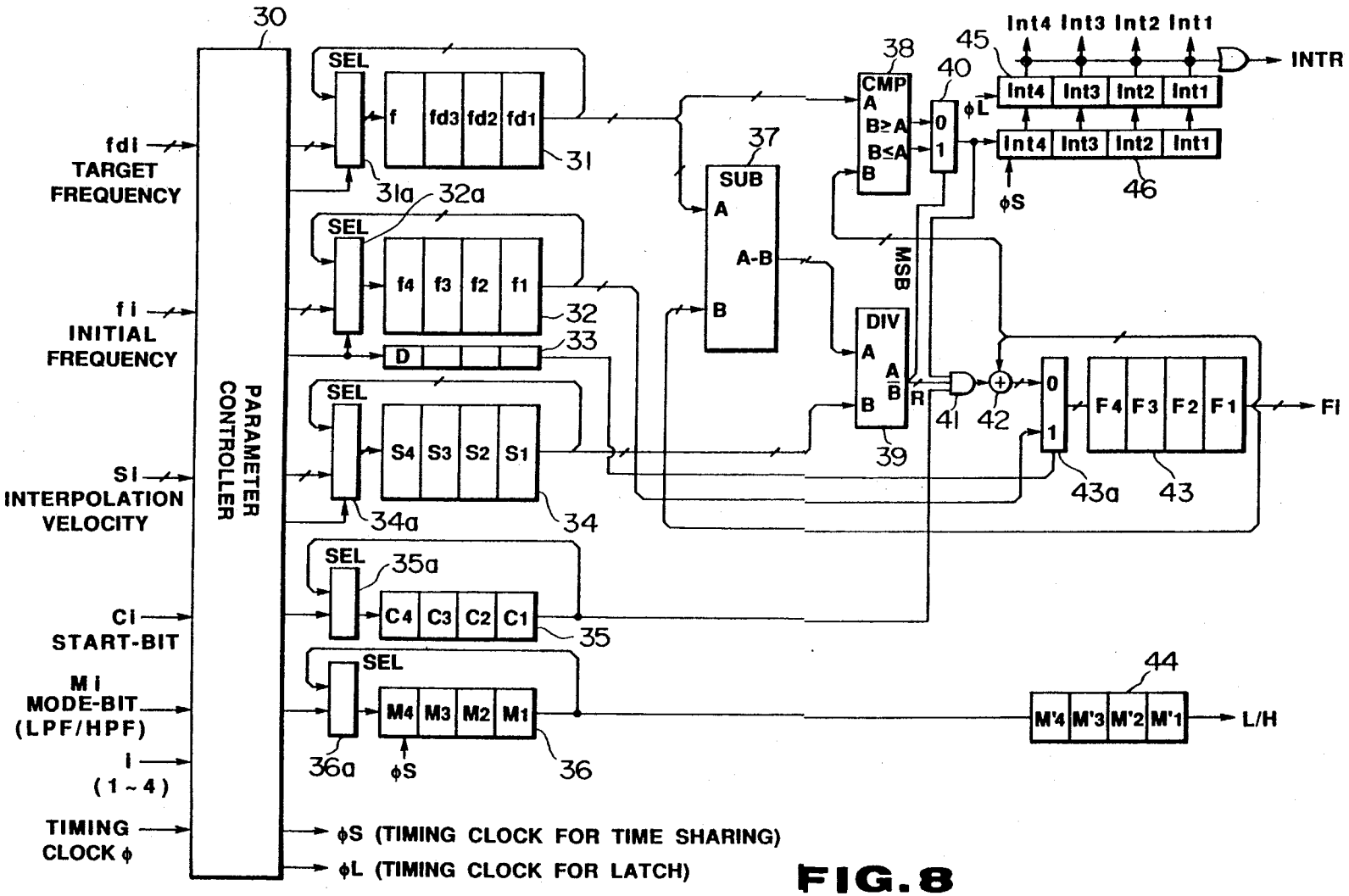
FIG. 8 is a block diagram showing a DCF controller 16*b* shown in FIG. 7.

In FIG. 8, the parameter controller 30 has a portion for generating timing clocks to write data, and outputs the target frequency fdi, the initial frequency fi, the interpolation velocity Si, the start-bit Ci and the mode-bit Mi to the selectors 31*a*, 32*a*, 34*a*, 35*a* and 36*a*, according to the state of filter designating number i.

The register 31 has four cells, and circulates data in each cell counterclockwise through the selector 31*a*. That is, the selector 31*a* selects either of the data outputted from the output-end cell of the register 31 or the data from the parameter controller 30, on the basis of the select signal S4, and outputs the selected data to the input-end cell of the register 31. The outputted data from the output-end cell is supplied to the selector 31*a*. However, the register 32 and the selector 32*a*, the register 34 and the selector 34*a*, the register 35 and the selector 35*a*, the register 36 and the selector 36*a* are constructed in the same way as mentioned above.

Therefore, the register 31 and the selector 31*a* circulates the target frequency fdi; the register 32 and the selector 32*a* circulates the cut-off frequency Fi; and the register 33 and the selector 33*a* circulates the interpolation velocity Si. These data are used to calculate the cut-off frequency Fi of the filter units FU1~FU4 shown in FIGS. 4(*a*)~(*h*).

A delay register 33 temporarily stores the delay bit DB.

Furthermore, the data of the output-end cell in the register 31, i.e., the target frequency fdi, is supplied to the selector 31*a*, an input-terminal A of a comparator 37 and an input-terminal A of a comparator 38. The data of the output-end cell in the register 32, i.e., the initial frequency fi, is supplied to an input-terminal of the selector 43*a*. The data of the output-end cell in the register 33, i.e., the interpolation velocity Si, is supplied to an input-terminal of the divider 39. Further, the data from the register 35, i.e., the start-bit Ci, is supplied to an AND circuit 41. The data from the register 36, i.e., the mode-bit Mi, is supplied to the register 44, wherein the data is temporarily stored in a register 44, and from which the data is outputted to the selector 18*a* as an L/H signal. The selector 18*a* selects either the HPF output or the LPF output, and outputs the selected data.

The subtractor 37 calculates a level difference D by subtracting the output data of the register 43, i.e., the cut-off frequency Fi, from the target frequency fdi, and outputs the level difference D to an input-terminal A of the divider 39. The divider 39 calculates a rate of increase R which designates a changing velocity of the cut-off frequency Fi, by dividing the level difference D by the interpolation velocity Si, and outputs the result to the AND circuit 41.

Next, the comparator 38 compares the cut-off frequency Fi (the output data of the register 43) with the target frequency fdi (the output data of the register 31). And, in accordance with the result of comparing, when the cut-off frequency fi does not reach the target frequency fdi yet, the comparator 38 sets a digit(1) on the input-terminal(0) side of the selector 40. When the present frequency Fi reaches the target frequency fdi, the comparator 38 sets a digit(1) on the input-terminal(1) side of the selector 40.

The AND circuit 41 outputs the rate R to the adder 42 when both the output data of the selector 40 and of the start-bit Ci are digit(1). The adder 42 adds the rate R and the output data of the register 43 (the cut-off frequency Fi), and outputs the added result to the selector 43*a*. The selector 43*a* outputs the rate R when the delay bit DB is (0), while, the selector 43*a* outputs the rate R when the delay bit DB is (1).

The register 43 circulates the cut-off frequency Fi (or the initial frequency fi) in cells, and stores the cut-off frequency newly calculated by the adder 42 in the input-end cell through the selector 43*a*. The cut-off frequency Fi in the output-end cell is outputted to the DCF 20 shown in FIG. 2. The shift register 46 has four cells, circulates each data in the four cells counterclockwise according to the timing clock, and stores the output data of the selector 40 in the input-end cell. When data corresponding to the filter designating number (1), i.e., data Int1, is moved into the output-end cell of the shift register 46, each data in the cells is supplied to the cell of the latch circuit 45. The latch circuit 45 latches the data (Int1, Int2, Int3 and Int4) from the shift register 46, and outputs them to the system controller 13 shown in FIG. 1. The contents of each of the cells is supplied to the OR circuit 47. Therefore, if at least one interrupt signal Inti is set, the interrupt signal INTR will be (1), and is supplied to the system controller 13.

In the registers 31, 32, 33, 34, 35, 36 and 43, the circulation and the movement of each data synchronizes with the timing clock $\phi$. For example, the DCF controller 16 shown in FIG. 8 is in a fixed stage, in which the cut-off frequency F1 for the first stage of the DCF 20 (filter unit FU1 shown in FIG. 4) is calculated and outputted.

Next, the operation of the above-mentioned electronic musical tone generating apparatus will described by referring to flow charts shown in FIG. 9, FIG. 10, FIG. 11, FIG. 12 and FIG. 13.

B. OPERATION OF EMBODIMENT

Figure 9:
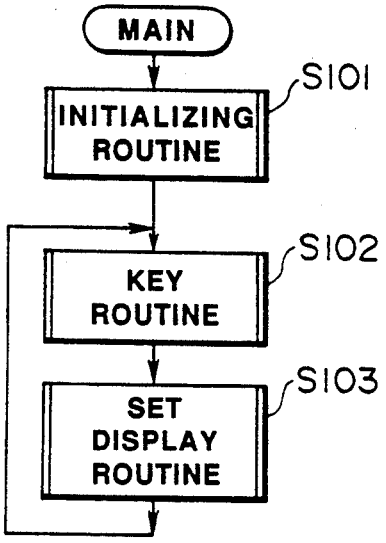
FIG. 9 is a flow chart showing a main routine of the embodiment.
Figure 10:
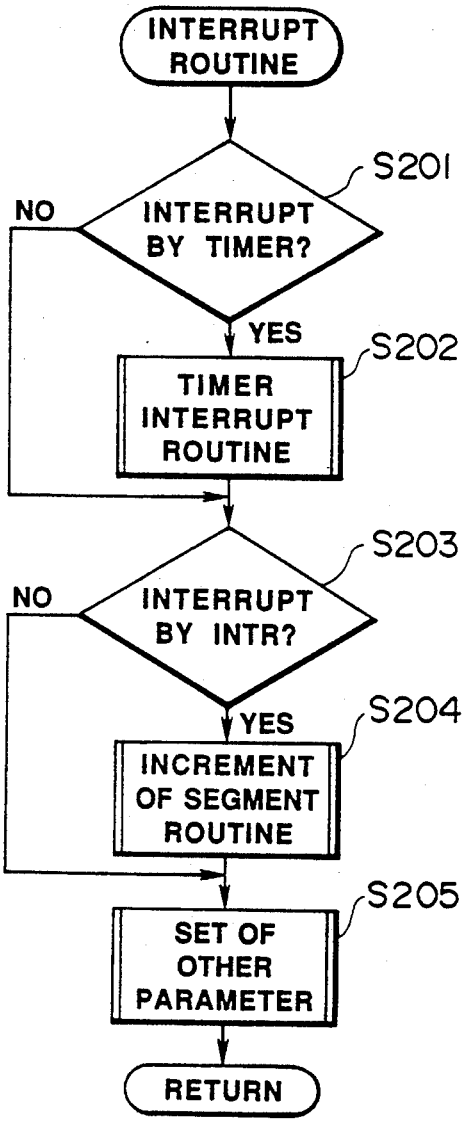
FIG. 10 is a flow chart showing an interrupt routine of the embodiment.

FIG. 9 is a flow chart showing the operation of the system controller. This is a main routine which is started by the system controller 13 when the power is applied.

Figure 11:
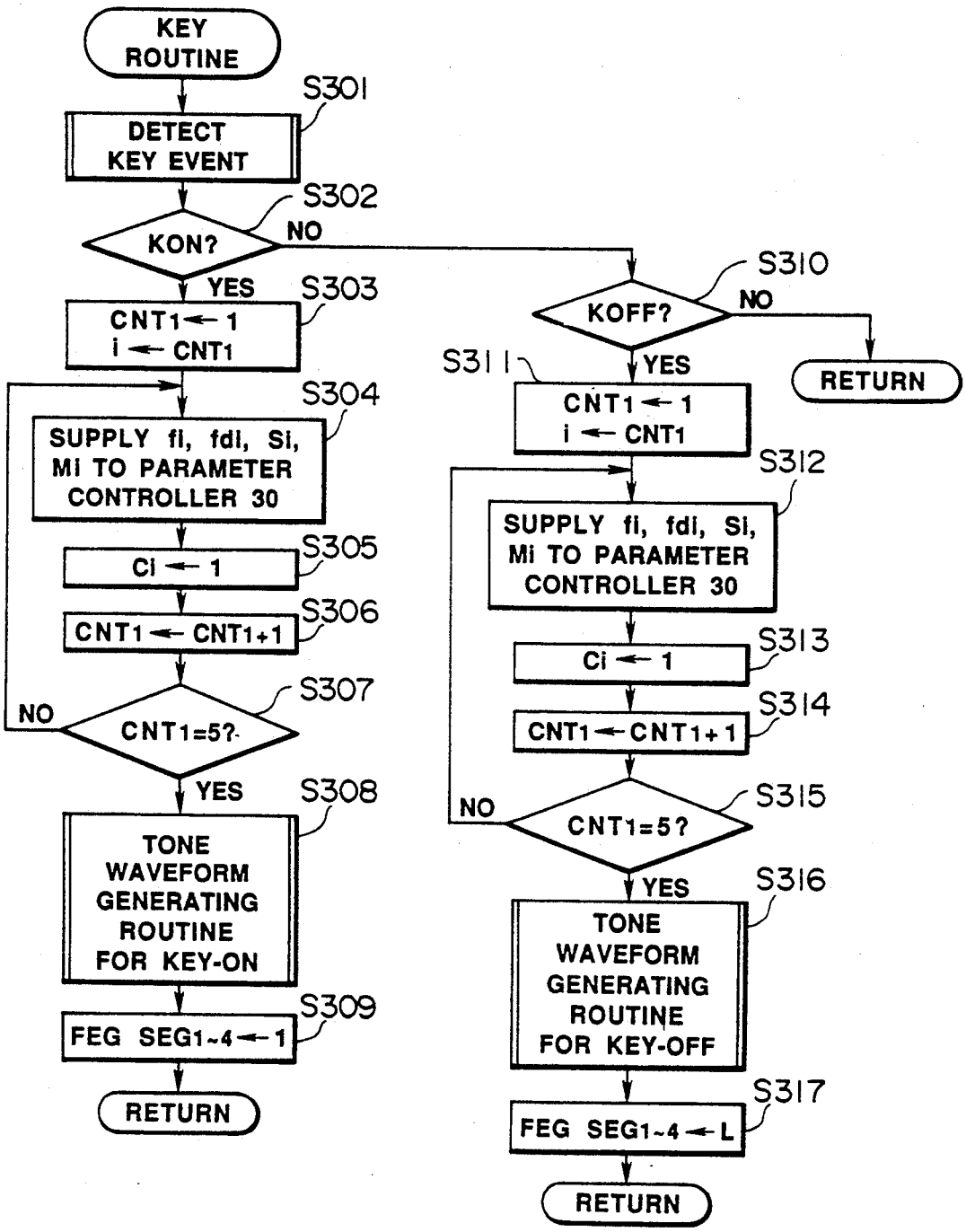
FIG. 11 is a flow chart showing a key routine of the embodiment.

At step S101, the system controller 13 initializes the parameters and the registers. At step S102, the key routine shown in FIG. 11 is performed. In FIG. 11, key events are detected at step S301. If any key is pressed by a performer, the key-on signal KON and the key-on velocity KV from keyboard 11 are supplied to the system controller 13. Then, the system controller 13 proceeds to step S302 in which a test is performed to distinguish whether the key-on signal KON is inputted or not. If the result is positive, control proceeds to step S303. At step S303, a counter CNT1 is incremented, so that it designates (1). The content of the counter CNT1, i.e., (1), is stored in the filter designating number i. Thus, the filter designating number i will be (1). Next, at step S304, the initial frequency f1(=present frequency) of the cut-off frequency Fi, the target frequency fd1, the interpolation velocity S1 and the mode bit M1 are supplied to the parameter controller 30. At step 305, the start bit C1 is set to (1); then it is also supplied to the parameter controller 30.

Herein, the parameter controller 30 stores the initial frequency f1, the target frequency fd1 and the interpolation velocity S1, into a certain cell of each register 31, 32, 34, 35 and 36.

Next, control proceeds to step S306, and the counter CNT1 is incremented, so that it designates (2). Then, at step S306, a test is performed to distinguish whether the counter CNT1 reaches (5) or not. At this time, the counter CNT1 is (2), so that the result in step S306 is negative and, the control returns to step S304. Then, the steps S304, S305 and S306 are repeatedly performed until the result is positive at step S306. Therefore, for the filter unit FU2, the target frequency fd2 of the cut-off frequency F2, the initial frequency F2 and the interpolation velocity S2 are supplied to the parameter controller 30. The tone designating information (fd2, f2 and S2) is stored in the certain cell of the registers 31, 32, 33, 34, 35 and 36.

Hereinafter, so that the above-mentioned loop routine is repeatedly performed, in the third loop routine, the target frequency fd3, the initial frequency f3 and the interpolation velocity S3 are supplied to the parameter controller 30. In the fourth routine loop, the target frequency fd4, the initial frequency f4 and the interpolation velocity S4 are supplied to the parameter controller 30. Each tone designating information(fd3,f3,S3 and fd4,f4,S4) is stored in the certain cell of the registers 31, 32, 33, 34, 35 and 36.

At step S307, the result is positive, and the control proceeds to step S308 in which keycode KC, key-on velocity KV and key-on signal KON are supplied to the tone waveform generator 14. Next, at step S309, segment-counters FEGSEG1~FEGSEG4 are turned to (1), and then control returns to the main routine. However, each segment-counter FEGSEG1~FEGSEG4 is in accord with filter unit FU1, FU2, FU3 and FU4, respectively. These segment-counters FEGSEG1~FEGSEG4 are used for registers in an interrupt routine shown in FIG. 12. The musical tone is separated into plural segments, and each segment has one data which designates an amplitude envelope of the musical tone. In other words, these data are at intervals corresponding to the read out interval of the tone waveform data. Thus, in the interrupt routine, the segments-counter FEGSEG1~FEFSEG4 are increment in incremented each time the cut-off frequency Fi reaches the target frequency fdi (i=1,2,3,4).

However, at step S308, the tone waveform generator 14 generates the tone waveform data according to the keycode KC, the key-on velocity KV and key-on signal KON, and outputs the tone waveform data to the filter system 15. The DCF controller 16*b* circulates the data in the cells of registers 31~36 and 43 with various timing clocks, and calculates a cut-off frequency Fi between the initial frequency fi and the target frequency fdi, by using a linear interpolation technique accordance to the interpolation velocity Si. That is, the tone designating information, in the output-end cell of each register 31, 32, 33, 34, 35 and 36, is used to calculate in each stage. Hereinafter, the performance of DCF controller 16*b* will be described in detail.

In the registers 31, 32, 33, 34, 35 and 36, the stored data, such as the target frequency fd1~fd4, the initial frequency f1~f4, delay-bit DB1~, the interpolation velocity S1~S4, the start-bit C1~C4 and the mode-bit M1~M4 circulate with fixed timing, and data in the output-end cells are outputted. In this case, the present frequency F1 from register 43 is supplied to the input-terminal B of the subtractor 37. Thus, the subtractor 37 calculates the level difference D by subtracting the cut-off frequency F1 from the target frequency fd1 (fd1>F1), and outputs the level difference D to the divider 39.

The divider 39 divides the level difference D with the interpolation velocity S1, from the register 34, and outputs the result to the AND circuit 41, as the rate R.

On the other hand, the comparator 38 compares the cut-off frequency F1 of the register 43 with the target frequency fd1, and outputs the compared result to the selector 40. In this case, the target fd1 is larger than the present cut-off frequency F1, so that the selector 40 outputs digit(1) to the AND circuit 41. And, because the start-bit C1 is also set to digit(1), the AND circuit 41 outputs the rate R to the adder 42. Further, the above-mentioned compared result is stored in the shift register 46.

Then, the rate R and the cut-off frequency F1 are added in the adder 42, and this added result is supplied to the selector 43*a*. The selector 43*a* outputs the added result to the register 43 according to the delay-bit DB. In other words, for example, it is assumed that the performance of this system is in the initial stage, and the register 43 hasn't any data, so the delay-bits DB1~DB4 are sequentially supplied to the selector 43*a* as select signal. Thus, the selector outputs the initial frequency fi (i.e., f1 to f4) to the register 43 in four stages from the beginning. The initial frequency f1~f4 is stored into each cell of the register 43.

The register 43 shifts the data in each cell thereof counterclockwise according to the timing clock $\beta$s, and stores data (new cut-off frequency F1) from the adder 42, into the input-end cell through the selector 43*a*.

Thereafter, the registers 31, 32, 33, 34, 35 and 36 shift data in each cell counterclockwise, sequentially. Therefore, the register 31 outputs the target frequencies fd2, fd3 and fd4, sequentially. And, the register 32 sequentially outputs the initial frequencies f2, f3 and f4. Further, the register 33 outputs the delay-bits DB2, DB3 and DB4, and the register 34 outputs the interpolation velocity S2, S3 and S4. The registers 35 and 36 also output the start-bits C2~C4 and the mode-bits M2~M4 respectively. In addition, the register 43 outputs the present cut-off frequency F2$\beta$F4 sequentially. And then, while data are outputted from the registers 31~36, each portion, such as the subtractor 37, the comparator 38, the divider 39 and the adder 42, calculates as mentioned above. Then the output data, i.e., new cut-off frequency Fi, of the adder 42 are stored in the cell of register 43. The cut-off frequencies F1~F4 are supplied to the DCF 20 (i.e., filter units FU1~F4 shown in FIG. 4), on the basis of the timing charts shown in FIGS. 6(*a*) and (*b*). In this case, the DCF 20 is divided to the four units (FU1, FU2, FU3 and FU4) by means of time sharing.

The cut-off frequencies F1~F4 change toward the target frequency fdi with an exponential curve, because the rate R is added to the present cut-off frequency Fi, sequentially. Thus, the tone waveform data which is filtered by DCF 20 is outputted to the latter circuits. In addition, the above-mentioned calculations are repeatedly performed until each cut-off frequency F1~F4 reaches the target frequencies fd1~fd4, respectively. That is, for example, if the present cut-off frequency F1 and reaches the target frequency fd1, the new target frequency fd1 is supplied to the register 31, then the calculation is performed with the new target frequency fd1, continuously. Thus, about the cut-off frequencies F2, F3 and F4 are the same way as the above mentioned.

On the other hand, if the result in step S302 is negative, that is, the key-on signal KON is not detected, the control proceeds to step S310. At step S310, a test is performed to distinguish whether the key-off signal is inputted from the keyboard or not. If the result is negative, that is, if any keys are not released by the performer, the control returns to the main routine. However, the result is positive in step S310, that is; if any keys are released by the performer, the control proceeds to step S311. At step S311, the counter CNT1 turns into (1), which content is stored in a variable i, so that the variable i turns into (1). Then, at step S312, the initial f1 (i.e., the present cut-off frequency F1), the target frequency fd1, the interpolation velocity S1 and the mode-bit M1 are supplied to the parameter controller 30. At step S313, the start-bit C1 turns into (1), then is supplied to the parameter controller 30. These tone designating information values are on the basis of a key-release operation. The tone designating information is stored into the registers 31, 32, 34, 35 and 36.

Next, at step S314, the counter CNT1 is incremented, so that it turns into (2). At step S315, the counter CNT1 is checked as to whether it is (5) or not. At this time, the counter CNT1 is set to (2), so that if the result is negative, then the control returns to step S304. Then, steps S304, S305 and S306 are performed again; thus, the target frequency td2, the initial frequency f2 and the interpolation velocity S2 for the cut-off frequency F2 are supplied to the parameter controller 30. These tone designating information values are also based on key-release operation. The tone designating information is stored in the register 31, 32, 34, 35 and 36.

Thereafter, the loop routine (steps S304, S305 and S306) is continuously performed until the result of step S307 assumes a positive state. In the third loop performance, the target frequency fd3, the initial frequency f3 and the interpolation velocity S3 are supplied to the parameter controller 30, and in the fourth loop performance the target frequency fd4, the initial frequency f4 and the interpolation velocity S4 are also supplied to the parameter controller 30. This tone designating information is stored into the register 31, 32, 34, 35 and 36 in each stage.

Then, if the result of step S315 is positive, the control proceeds to step S316 in which the key-off routine is performed in the tone waveform generating circuit 14. Next, at step S317, a number of segment L is stored in the segments FEGSEG1~FEGSEG4 respectively. The control proceeds to the main routine.

However, the DCF controller 16*b* calculates the cut-off frequencies F1~F4 in the same way as mentioned above, and the output data of the adder 42, i.e., the new cut-off frequencies F1~F4, are stored in the cell of the register 43, sequentially. These cut-off frequencies F1~F4 are sequentially supplied to the DCF 20, which is used as filter units FU1, FU2, FU3 and FU4(See FIG. 4) by use of a time sharing technique, according to the timing charts shown in FIG. 6.

The described calculations are performed repeatedly and automatically until the tone waveform data is completed, but unaccompanied by the system controller 13.

However, when the control returns to the main routine from the subroutines, it proceeds to step S103 in which the same parameters are set and displayed. Then, the control returns to steps S101, S102 and S103, which are performed repeatedly. In addition, while the above-mentioned calculation processes are performed, in the DCF controller 16*b*, if any cut-off frequency Fi reaches the target frequency fdi, the cell corresponding to the filter designating number i of the shift register 46 is set to (1). Next, the contents of the shift register 46 are supplied to the system controller 13 as the interrupt signal INTR. When the system controller 13 is interrupted with the timer interrupt or with the INTR interrupt, an interrupt routine is performed. Hereinafter, the interrupt routine will be described by referring to the flow chart shown in FIG. 10.

Figure 12:
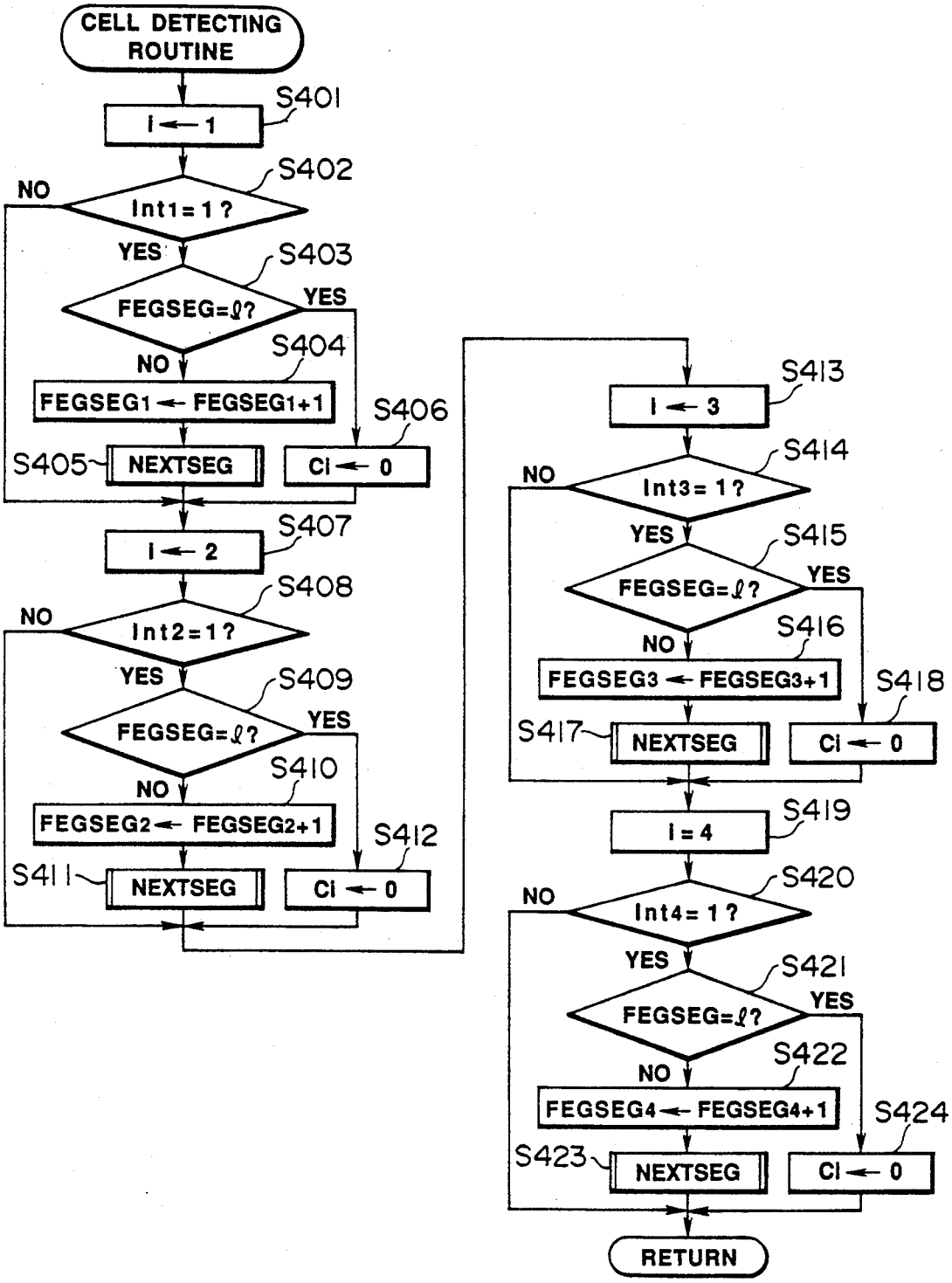
FIG. 12 is a flow chart showing a filter routine of the embodiment.

When any interrupts occur, first of all the control proceeds to step S201 in which a test is performed to distinguish whether it is interrupted by timer (an uniform interval signal) or not. If the result is positive, the control proceeds to step S202. At step S202, a low frequency waveform for the tone modulation is generated by low frequency oscillator (LFO). On the other hand, if the result is negative at step S201, or when step S202 is completed, the control proceeds to step S203. At step S203, a test is performed to distinguish whether it is interrupted by signal INTR or not. And, if the result is positive, the control proceeds to step S204 in which a cell detecting routine shown in FIG. 12 is performed.

Figure 13:
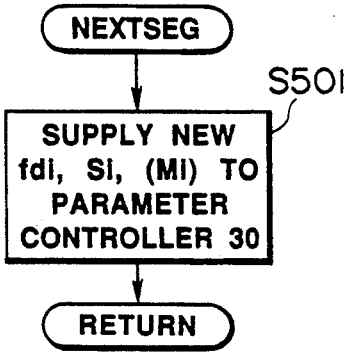
FIG. 13 is a flow chart showing a next segment writing routine of the embodiment.
Figure 14:
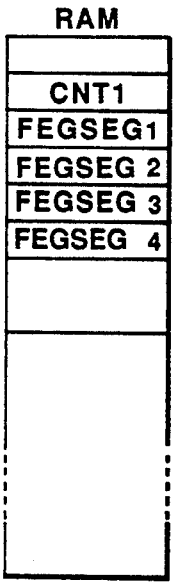
FIG. 14 is a schematic representation of a random access memory (RAM) 13*b* shown in FIG. 1.

In this cell detecting routine, some tests are performed to check which cells of the shift register 45 the interrupt had caused. At step S401, the filter designating number i is set to (1). And, at step S402, a test is performed to check whether the interrupt signal Int1 is set or not. Herein, it is assumed that the cut-off frequency F1 had reached the target frequency fd1, and the interrupt signal Int1 had been set. If the result will be positive, then the control proceeds to step S403. At step S403, a test is performed to distinguish whether the segment register FEFSEG1 reaches a maximum L or not. If the result is negative, the control proceeds to step S404 to calculate the cut-off frequency F1 continuously. At step S404, the segment register FEGSEG1 is incremented, and then the control proceeds to step S405 in which the segment writing routine NEXTSEG shown in FIG. 13 is performed.

In this routine NEXTSEG, at step S501, the new target frequency fd1, the new interpolation velocity S1 and the new mode-bit M1 are supplied to the parameter controller 30. The parameter controller 30 stores the new target frequency f1, the new interpolation velocity S1 and the new mode-bit M1 in the cells of the register 31, 34 and 36. Then, when steps S501 is completed, the control returns to step S407 in the cell detecting routine.

On the other hand, if the result is positive at step S403, the control proceeds to step S406 to finish the calculation for the cut-off frequency F1. At step S406, the start-bit C1 is set to (0), so that the AND circuit 41 is closed. Thus, the rate R is not outputted. Hence, the register 43 outputs the uniform cut-off frequency F1 which is the remaining data, to the filter unit FU1. In the case where step S406 is completed, or when the result is negative at step S402, i.e., the interrupt signal Int1 is not set, and the control proceeds to step S407.

At step S407, the filter designating number i is set to (2). Then, at step S408, a test is performed to check whether the interrupt signal Int2 has been set or not. Herein, it is assumed that the cut-off frequency F2 had reached the target frequency fd1, and the interrupt signal Int2 had been set. If the result will be positive, then the control proceeds to step S409. At step S409, a test is performed to distinguish whether the segment register FEFSEG2 reaches a maximum L or not. If the result is negative, the control proceeds to step S410 to calculate the cut-off frequency F2 continuously. At step S410, the segment register FEGSEG2 is incremented, and then the control proceeds to step S411 in which the segment writing routine NEXTSEG is performed. In this routine NEXTSEG, at step S501, the new target frequency fd2, the new interpolation velocity S2 and the new mode-bit M2 are supplied to the parameter controller 30. The parameter controller 30 stores the new target frequency f2, the new interpolation velocity S2 and the new mode-bit M2 into the cells of the register 31, 34 and 36. Then, when step S501 is completed, the control returns to step S413 in the cell detecting routine.

On the other hand, if the result is positive at step S409, the control proceeds to step S412 to finish the calculation for the cut-off frequency F1. At step S412, the start-bit C2 is set to (0), so that the AND circuit 41 is closed. Thus, the rate R is not outputted. Hence, the register 43 outputs the uniform cut-off frequency F2 which is remaining data, to the filter unit FU2. In the case where step S412 is completed, or when the result is negative at step S408, i.e., the interrupt signal Int2 is not set, then the control proceeds to step S413.

At step S413, the filter designating number i is set to (3). Then, at step S414, a test is performed to check whether the interrupt signal Int3 has been set or not. Herein, it is assumed that the cut-off frequency F3 had reached the target frequency fd3, and the interrupt signal Int3 had been set. If the result will be positive, then the control proceeds to step S415. At step S415, a test is performed to distinguish whether the segment register FEFSEG3 reaches a maximum L or not. If the result is negative, the control proceeds to step S416 to calculate the cut-off frequency F3 continuously. At step S416, the segment register FEGSEG3 is incremented, and then the control proceeds to step S417 in which the segment writing routine NEXTSEG is performed. In this routine NEXTSEG, at step S501, the new target frequency fd3, the new interpolation velocity S3 and the new mode-bit M3 are supplied to the parameter controller 30. The parameter controller 30 stores the new target frequency f3, the new interpolation velocity S3 and the new mode-bit M3 into the cells of the register 31, 34 and 36. Then, when step S501 is completed, the control returns to step S419 in the cell detecting routine.

On the other hand, if the result is positive at step S415, the control proceeds to step S418 to finish the calculation for the cut-off frequency F3. At step S418, the start-bit C3 is set to (0), so that the AND circuit 41 is closed. Thus, the rate R is not outputted. Hence, the register 43 outputs the uniform cut-off frequency F3 which is the remaining data, to the filter unit FU3. And then, in the case where step S418 is completed, or when the result is negative at step S414, then the control proceeds to step S419.

At step S419, the filter designating number i is set to (4). Then, at step S420, a test is performed to check whether the interrupt signal Int4 has been set or not. Herein, it is assumed that the cut-off frequency F4 had reached the target frequency fd4, and the interrupt signal Int4 had been set. If the result will be positive, then the control proceeds to step S421. At step S421, a test is performed to distinguish whether the segment register FEFSEG4 reaches a maximum L or not. If the result is negative, the control proceeds to step S422 to calculate the cut-off frequency F4 continuously. At step S422, the segment register FEGSEG4 is incremented, and then the control proceeds to step S423 in which the segment writing routine NEXTSEG is performed. In this routine NEXTSEG, at step S501, the new target frequency fd4, the new interpolation velocity S4 and the new mode-bit M4 are supplied to the parameter controller 30. The parameter controller 30 stores the new target frequency f4, the new interpolation velocity S4 and the new mode-bit M4 in the cells of the register 31, 34 and 36. Then, when step S501 is completed, the control returns to the cell detecting routine.

On the other hand, if the result is positive at step S421, the control proceeds to step S424 to finish the calculation for the cut-off frequency F4. At step S424, the start-bit C4 is set to (0), so that the AND circuit 41 is closed. Thus, the rate R is not outputted. Hence, the register 43 outputs the uniform cut-off frequency F4 which is the remaining data, to the filter unit FU4. And then, in the case where step S424 is completed, or when the result is negative at step S420, the control returns to the interrupt routine shown in FIG. 10.

In the interrupt routine, at step S205, other parameters are set, and then the control returns to the main routine.

While the interrupt routine is performed, the DCF controller 16*b* calculates the cut-off frequency F1~F4 between the present frequency F1~F4 and the target frequency fd1~fd4 in accordance with the interpolation velocity S1~S4. The cut-off frequency F1~F4 is supplied to the DCF 20 in each stage. That is, the cut-off frequency F1 is supplied to the filter unit FU1, the cut-off frequency F2 is supplied to the filter unit FU2, the cut-off frequency F3 is supplied to the filter unit FU3, and the cut-off frequency F4 is supplied to the filter unit FU4. Hence, the tone waveform data is filtered by the filter units FU1, FU2, FU3 and FU4, thereafter, outputs to the latter circuits.

Figure 15:
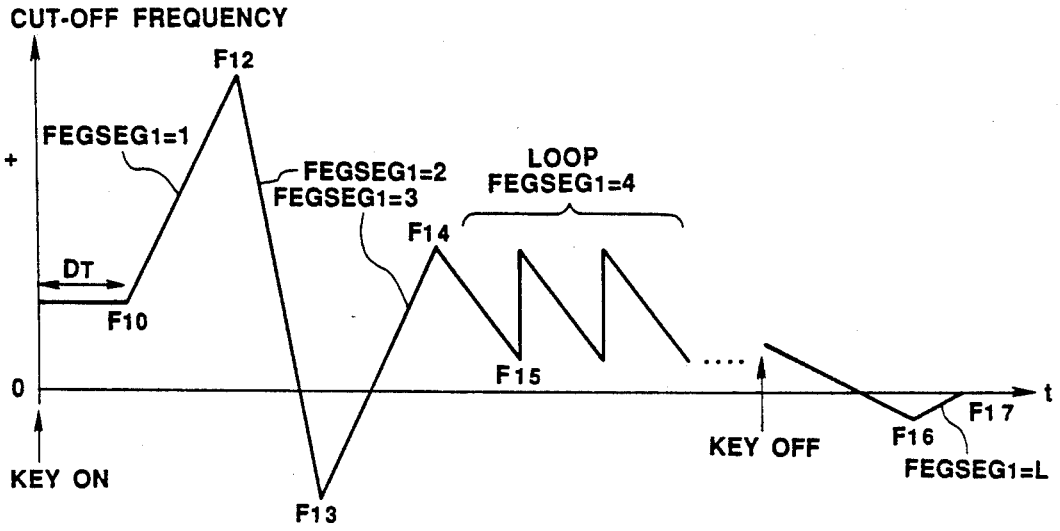
FIG. 15 is a waveform chart showing an example of a cut-off frequency F1 in the embodiment.

Herein, for example, the cut-off frequency F1 for filter unit FU1 is shown in FIG. 15. In FIG. 15, the target frequency fd1 is set to F12 in the first stage, and the initial frequency f1 is also set to F10 in the first stage. When the cut-off frequency F1 reaches the target frequency F12, the target frequency fd1 is set to F13, and the initial frequency f1 is set to F12. Thereafter, the target frequency fd is set to F14, F15 . . . , sequentially. The initial frequency f1 is also set to F13, F14, . . . , sequentially. Thus, the cut-off frequency F1 is changed with passing time. In this case, the target frequency fd1 is repeatedly set to F14 and F15 until the key-off signal KOFF is inputted. Thereafter, in the key-off stage, the target frequency fd1 is set to F16, F17, sequentially. As a result, the cut-off frequency F for filter unit FU1 is changed with passing time as shown in FIG. 15. However, each cut-off frequency F2, F3 and F4 for filter unit FU2, FU3 and FU4, is changed with passing time as mentioned above. And, when the segment counter FEGSEG1 reaches a maximum L finally, then the control is completed.

As a result, according to this modified example, it is possible to obtain the musical tone without expanding and complicating the apparatus. In addition, it is possible to obtain the a varied musical tone whose tone color can be varied smoothly.

C. MODIFIED EXAMPLES OF PRESENT EMBODIMENT

It is possible to modify the present embodiment into an example as follows.

Figure 16:
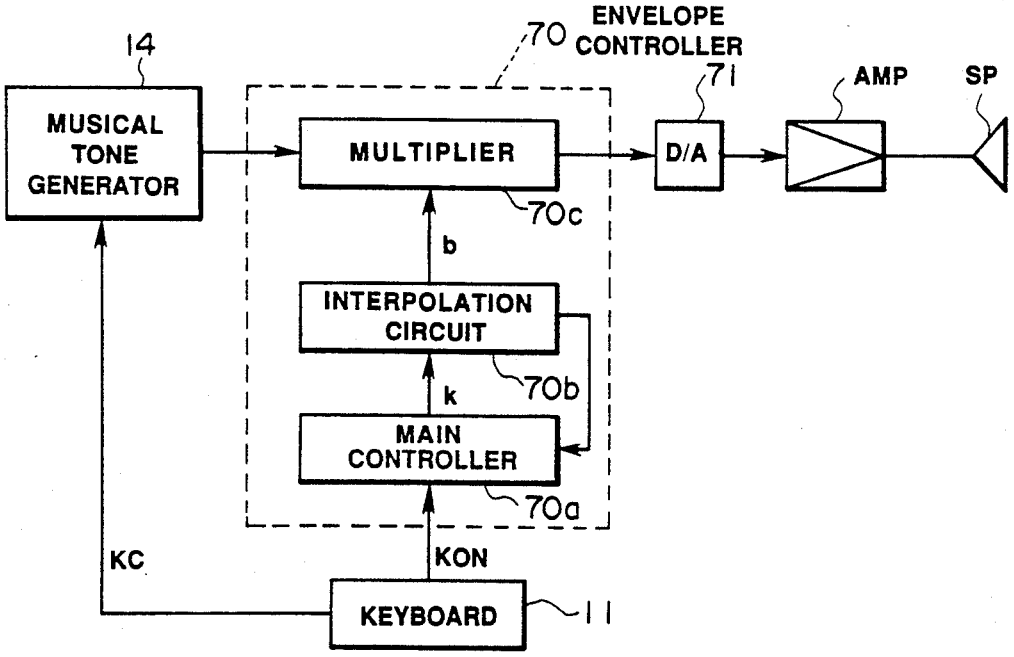
FIG. 16 is a block diagram showing the electrical configuration of the electronic musical tone generating apparatus which controls an envelope only.

FIG. 16 is a block diagram showing the electrical configuration of the electrical music tone generating apparatus which controls an envelope of amplitude only, instead of an envelope of cut-off frequency of the filter system 15.

In FIG. 16, the envelope controller 70 consists of a main controller 70*a*, an interpolation circuit 70*b* and a multiplier 70*c*. The main controller 70*a* generates a target data k in accordance with the key-on signal KON which is outputted by keyboard 11; further it controls various processes such as setting waveform and key scanning. The target data K is supplied to the interpolation circuit 70*b*. The interpolation circuit 70*b* calculates a multiple coefficient b by the linear or exponential interpolation technique, on the basis of the target data k. That is, the multiple coefficient b approaches the target data k gradually with passing time. And, the multiple coefficient b is supplied to the multiplier 70*c*. The multiplier 70*c* multiply a musical tone from the musical tone generator 14 by the multiple coefficient b. In addition, the interpolation circuit 70*b* provides an interrupt signal INTR to main controller 70*a* when the multiple coefficient b reaches the target data K. The main controller 70*a* generates the next target data K1 according to the same interrupt routine as in FIG. 10 in response to the interrupt signal INTR, and outputs the new target data K1 as the target data K. The supplementor 70*b* then calculates the multiple coefficient b which approaches the target data K1 gradually.

As a result, the amplitude envelope of the musical tone is changed, and then this musical tone is supplied to a D/A converter 71.

As described above, the main controller 70*a* generates plural target data K sequentially, and the interpolation circuit 70*b* generates the multiple coefficient b, which changes gradually, on the basis of each target data K. Therefore, the amplitude envelope of the musical tone changes with passing time.

Next, the D/A converter 71 converts the musical tone (digital data) to the tone waveform signal (analog signal), and then the tone waveform signal is supplied to an amplifier AMP to amplify. Then, the amplified tone waveform signal is outputted as a musical sound by speaker SP.

Furthermore, when a key-off signal KOFF from keyboard 11 is inputted, the main controller 70*a* generates the target data K'0 which is according to the key-off stage.

As a result, according to this modified example, it is possible to obtain the musical tone whose amplitude is variable, without expanding and complicating the apparatus. In addition, it is possible to obtain the musical tone in which not only frequency characteristic (tone color) but also amplitude can be varied smoothly.

What is claimed is:

1. A musical tone generating apparatus comprising:

musical tone source means for generating a musical tone signal; and parameter control means responsive to the musical tone signal for controlling a tone parameter which characterizes tone color of said musical tone signal by changing a value of said tone parameter, said parameter control means comprising:

target value generating means for generating a target value of said tone parameter;

interpolating means for interpolating between a present value of said tone parameter and said target value, so that said present value is renewed consecutively; and plural filtering units connected with combinations of parallel or series connections to one another, at least one of said plural filtering units changing a frequency characteristic of said musical tone signal based on said present value.

2. A musical tone generating apparatus in accordance with claim 1, wherein said interpolating means calculates said present value by using an exponential interpolation technique so that said present value changes toward said target value with an exponential curve.

3. A musical tone generating apparatus in accordance with claim 1, wherein said interpolating means calculates said present value by using a linear interpolation technique so that said present value changes toward said target value lineally.

4. A musical tone generating apparatus in accordance with claim 1, wherein said parameter control means changes an amplitude of said musical tone signal based on said present value.

5. A musical tone generating apparatus in accordance with claim 1, wherein said parameter control means further comprises a filtering unit which changes a frequency characteristic of said musical tone signal based on said present value.

6. A musical tone generating apparatus in accordance with claim 1, wherein said parameter control means further comprises one or more target value generating means and one or more interpolating means, so that plural present values of said tone parameter are produced, wherein at least one of said plural filtering means changes a frequency characteristic of said musical tone signal based on one of said present values, and amplitude of said musical tone signal is changed based on one of said present values.

7. A musical tone generating apparatus comprising:

musical tone source means for generating a musical tone signal; and parameter control means responsive to the musical tone signal for controlling a tone parameter which characterizes tone color of said musical tone signal by changing a value of said tone parameter, said parameter control means comprising:

target value generating means for generating a target value of said tone parameter; and interpolating means for interpolating between a present value of said tone parameter and said target value, so that said present value is renewed consecutively;

said target value generating means comprising a central processing unit and said operation of said target value generating means including an operation to determine and set a basic tone waveform of said musical tone signal to be generated, wherein said central processing unit operates to generate said target value only when said interrupt signal is provided from said interpolating means.

8. A musical tone generating apparatus in accordance with claim 7, wherein said interpolating means calculates said present value by using an exponential interpolation technique so that said present value changes toward said target value with an exponential curve.

9. A musical tone generating apparatus in accordance with claim 7, wherein said interpolating means calculates said present value by using a linear interpolation technique so that said present value changes toward said target value lineally.

10. A musical tone generating apparatus in accordance with claim 7, wherein said parameter control means changes an amplitude of said musical tone signal based on said present value.

11. A musical tone generating apparatus in accordance with claim 7, wherein said parameter control means further comprises a filtering unit which changes a frequency characteristic of said musical tone signal based on said present value.

12. A musical tone generating apparatus comprising:

musical tone source means for generating a musical tone signal; and parameter control means responsive to the musical tone signal for controlling a tone parameter which characterizes tone color of said musical tone signal by changing a value of said tone parameter, said parameter control means comprising:

target value generating means for generating a target value of said tone parameter; and interpolating means for interpolating between a present value of said tone parameter and said target value, so that said present value is renewed consecutively;

said target value generating means and said interpolating means operating independently, said interpolating means generating an interrupt signal to said target value generating means when said present value reaches said target value, so that operation of said target value generating means is interrupted, and then said target value generating means operating to generate a new target value to said interpolating means in response to said interrupt signal.

13. A musical tone generating apparatus in accordance with claim 12, wherein said interpolating means calculates said present value by using an exponential interpolation technique so that said present value changes toward said target value with an exponential curve.

14. A musical tone generating apparatus in accordance with claim 12, wherein said interpolating means calculates said present value by using a linear interpolation technique so that said present value changes toward said target value lineally.

15. A musical tone generating apparatus in accordance with claim 12, wherein said parameter control means changes an amplitude of said musical tone signal based on said present value.

16. A musical tone generating apparatus in accordance with claim 12, wherein said parameter control means further comprises a filtering unit which changes a frequency characteristic of said musical tone signal based on said present value.

* * * * *